US005114129A

United States Patent [19]

Chang et al.

[11] Patent Number: 5,114,129

[45] Date of Patent: May 19, 1992

[54] SIGNATURE FEEDING APPARATUS

[75] Inventors: Robert Chang, Westlake Village; Thomas J. McNicholas, Sr., Fountain Valley, both of Calif.

[73] Assignee: R. R. Donnelley & Sons Company, Chicago, Ill.

[21] Appl. No.: 628,484

[22] Filed: Dec. 14, 1990

[51] Int. Cl.[5] ..... B41F 13/54

[52] U.S. Cl. ..... 270/1.1; 270/54; 271/31; 271/157

[58] Field of Search ..... 270/1.1, 52, 54, 58; 271/3.1, 152, 157, 147, 149; 414/795.8, 416, 417, 330, 391, 392, 798.8

[56] References Cited

U.S. PATENT DOCUMENTS

| | | | |
|---|---|---|---|
| 1,547,724 | 7/1925 | Berry . | |
| 3,226,112 | 12/1965 | Kuever . | |
| 3,635,463 | 1/1972 | Stobb | 271/3.1 |
| 3,843,115 | 10/1974 | Di Fulvio et al. . | |
| 3,880,419 | 4/1975 | Swanson | 271/3.1 |
| 4,180,259 | 12/1979 | Bewersdorf | 271/3.1 |
| 4,183,516 | 1/1980 | Young | 271/3.1 |
| 4,436,297 | 3/1984 | Chandhoke | 271/3.1 |
| 4,662,624 | 5/1987 | Focke . | |
| 4,772,003 | 9/1988 | Nobuta | 270/58 |
| 4,795,144 | 1/1989 | Yeoman | 270/58 |
| 4,907,941 | 3/1990 | Focke | 271/157 |
| 4,921,388 | 5/1990 | Nelson . | |
| 4,981,292 | 1/1991 | Cosgrove | 270/54 |
| 5,005,815 | 4/1991 | Auksi | 270/1.1 |

FOREIGN PATENT DOCUMENTS

| | | | |
|---|---|---|---|
| 175629 | 10/1982 | Japan | 271/157 |

*Primary Examiner*—Edward K. Look
*Assistant Examiner*—Therese M. Newholm
*Attorney, Agent, or Firm*—Wood, Phillips, VanSanten, Hoffman & Ertel

[57] ABSTRACT

In order to avoid ergonomic problems such as carpel tunnel syndrome while improving productivity, an apparatus for feeding signatures to a binding line is disclosed. The apparatus includes a pocket adjacent a binding line for receiving signatures to be delivered to the binding line. It also includes first and second signature feeders for feeding signatures from a source to a signature transfer mechanism which extends to the pocket adjacent the binding line. The apparatus further contemplates at least one of the signature feeders receiving signatures directly from the source. In order to facilitate the efficient operation of the signature feeders of the invention, the signature transfer mechanism has a signature receiving end. The signature receiving end is positioned above the signature feeders and is adapted to transfer signatures to the pocket in either a shingled stream fashion or a one-at-a-time fashion. The signature transfer mechanism also has a signature transferring end positioned adjacent the pocket.

56 Claims, 9 Drawing Sheets

Fig. 9
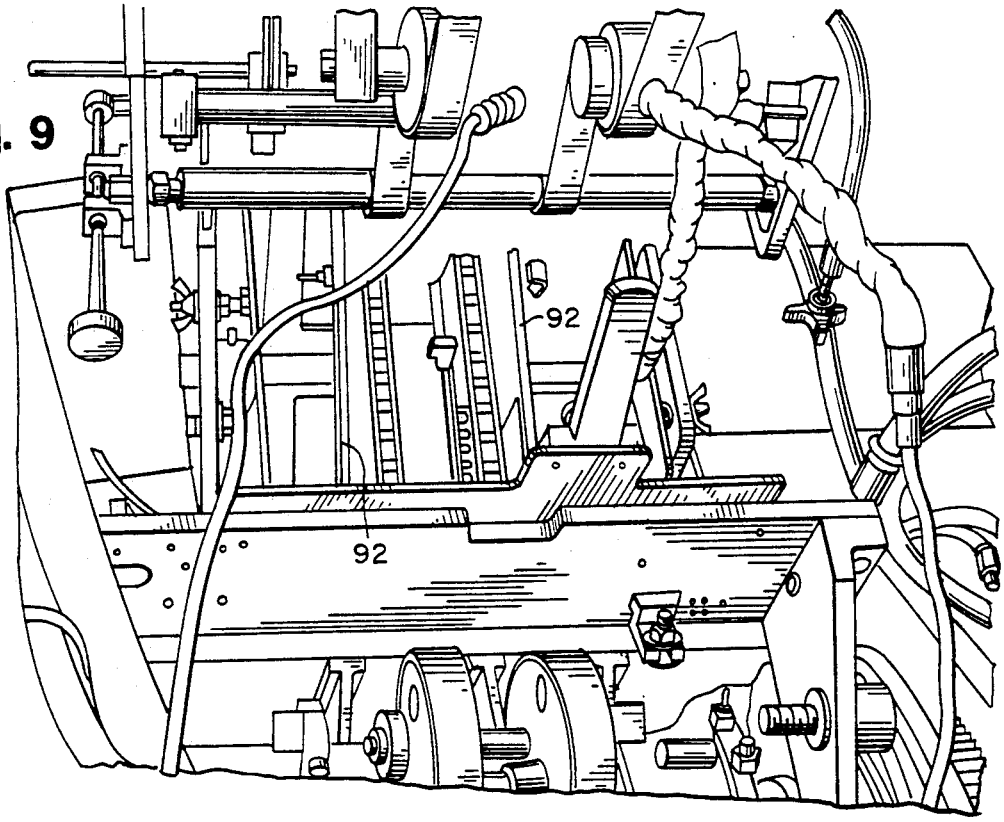
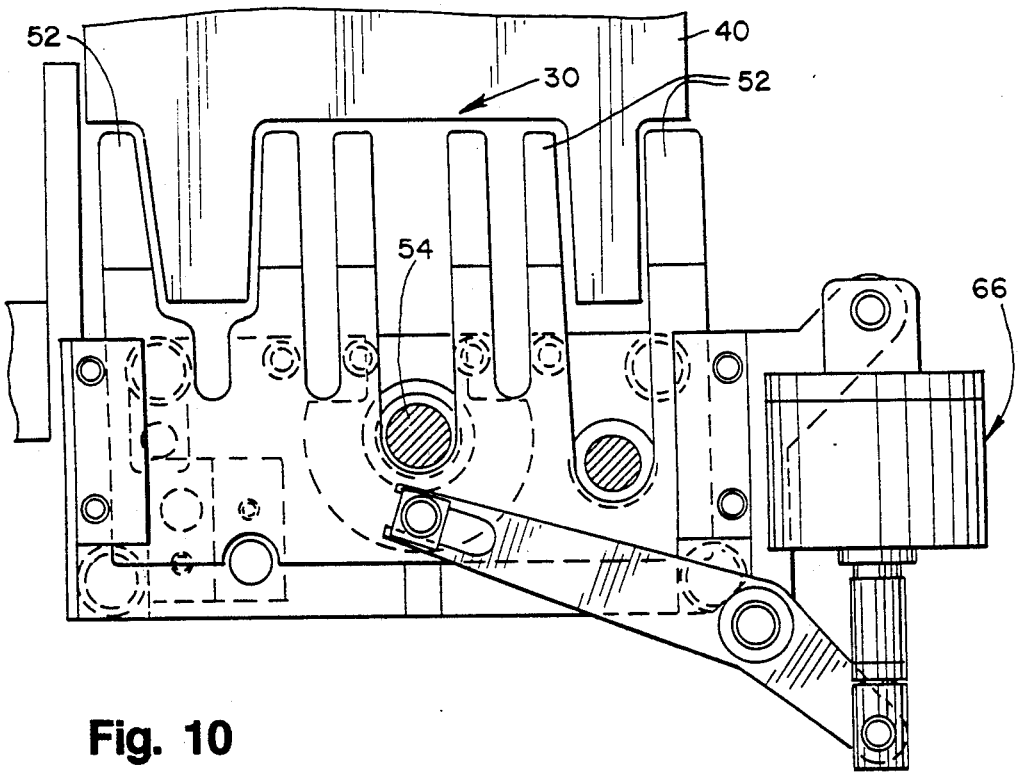
Fig. 10

Fig.15
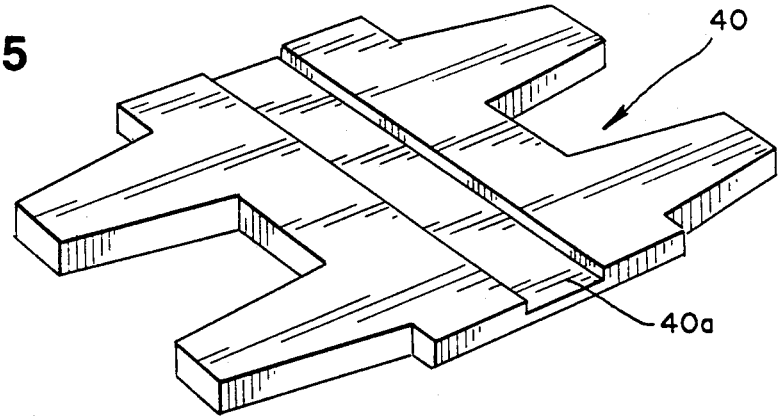
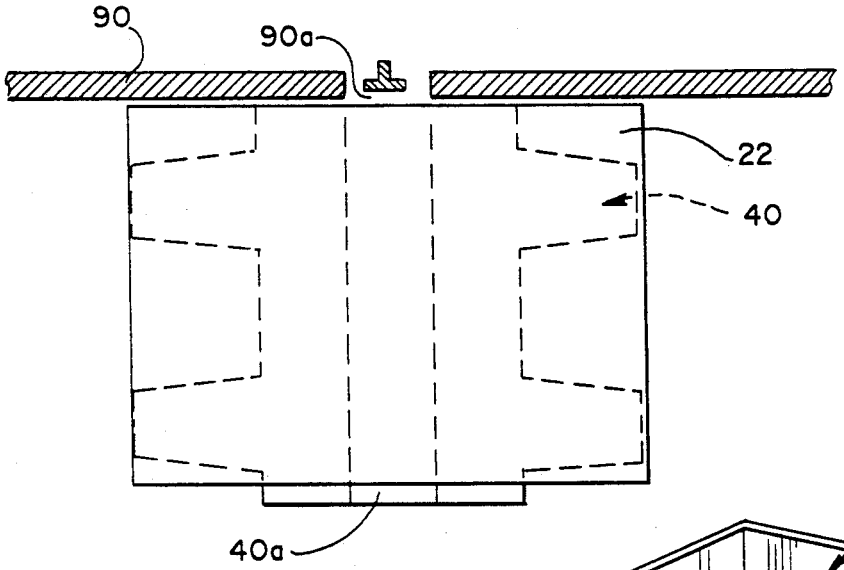
Fig.16
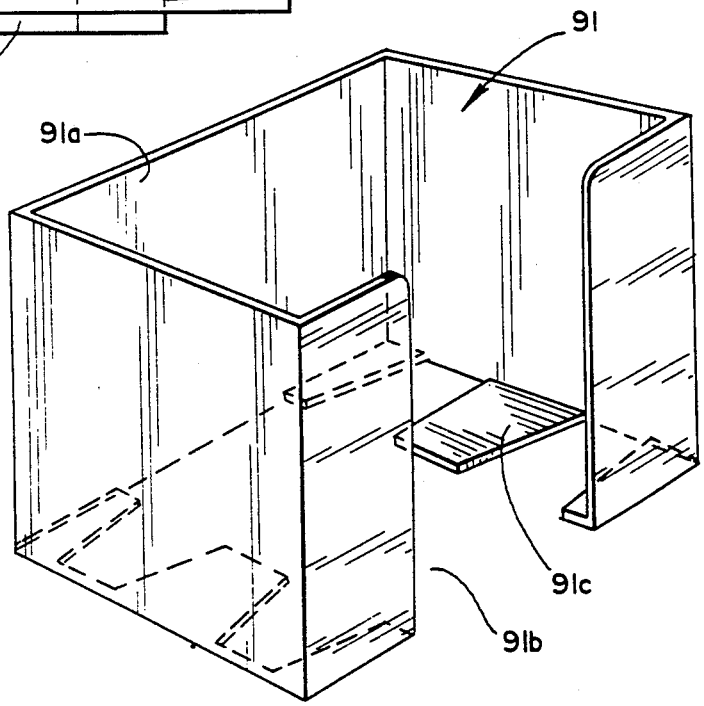
Fig.17

SIGNATURE FEEDING APPARATUS

FIELD OF THE INVENTION

The present invention is generally directed to a signature feeder and, more particularly, an apparatus for feeding signatures to a binding line.

BACKGROUND OF THE INVENTION

In recent years, many large circulation periodicals have appeared which require rapid handling of portions of the periodicals consisting of signatures which are gathered for binding, trimmed, bundled for minimum shipping costs, and shipped. A typical operation utilizes a multitude of inserter pockets, each of which receives signatures seriatim from a signature supply means, opens each signature, and drops the signatures to successively straddle a gathering chain which runs in front of the inserter pockets and carries the complete collection of gathered signatures to a location for further processing to complete the binding process. Moreover, because of the need for highly efficient plant operations, there has been a constant effort to increase the speed at which machines operate which has required the development of new techniques for handling the signatures at all stages of the binding process.

In addition to high speed operation, many large circulation periodicals are now demanding a degree of flexibility that has heretofore been considered impossible. This is particularly true, for instance, where the periodical wishes to include one or more personalized messages or other customized information or the like, but this must be done without significant reduction in the cyclic rate of operation that would otherwise decrease plant efficiency thereby increasing costs while possibly failing to accommodate the high volume presently produced by the U.S. printing industry which requires that the most efficient possible use be made of manpower, equipment and plant space. Furthermore, since the need for individualized message printing is sporadic, the equipment to achieve this objective should be compatible with a normal bindery line.

In the past, the only known manner of printing an individualized message on an internal signature in a binding operation has been less than entirely satisfactory. More specifically, it is known to print such a message or information on such a signature, provided this is done only after the signature is on a binding line conveyor which means that, due to the high speed operation of a binding line conveyor coupled with the fact that the backbone travels in the direction of travel of the conveyor, any such printing had to be parallel to the backbone (see, for instance, U.S. Pat. Nos. 4,121,818 and 4,395,031). While this has sometimes been found to be acceptable for certain applications, it would be most desirable to also be able to print in a direction perpendicular to the backbone.

In other words, by printing in a direction perpendicular to the backbone, it would be possible to provide individualized messages oriented in a normal fashion. Thus, the individualized message could be incorporated directly into text already on a given page of a signature where it would appear that the original printing of the signature had incorporated that message. In this manner, large circulation periodicals could achieve a degree and level of flexibility that has heretofore been considered impossible.

Most recently, truly successful apparatus and methods for individually printing signatures during delivery to a binding line conveyor have been achieved These apparatus and methods are fully illustrated, described and claimed in commonly owned and copending patent application of Gunnar Auksi for: "Apparatus and Method for Individually Printing Signatures During Delivery to a Binding Line Conveyor," U.S. Ser. No. 224,332, filed July 26, 1988, and commonly owned and copending patent application of Mayer et al. for: "Apparatus and Method for Individually Printing Signatures During Delivery to a Bindery Line," U.S. Ser. No. 557919, filed July 25, 1990, U.S. Pat. No. 5,080,337. Despite the achievements of the apparatus and methods of these earlier filed applications, it has remained to further the availability of commercially satisfactory techniques.

More specifically, these apparatus and methods tended to operate, in other respects, as conventional inserter pockets. This was quite effective but, in even more recent times, there has been a growing awareness of certain additional problems in terms of the productivity of binding lines, especially certain ergonomic problems such as carpel tunnel syndrome, that are often experienced by binding line employees. As for these problems, it will no doubt be appreciated that they exist whether or not ink jet printing is required and/or utilized.

Moreover, these problems are known to exist regardless of the technique of feeding the signatures to the binding line. Thus, it would be highly desirable to provide a new and improved apparatus for feeding signatures to a binding line in either a shingled stream fashion or one-at-a-time fashion. Still additionally, it would be highly desirable to further enhance the versatility as well as the productivity of signature feeding in a binding line.

For this purpose, it will be appreciated that any apparatus that was proposed necessarily had to be compatible with the limit on the space that is available in a binding line facility. In development of the present invention, it was established as a goal for the signature feeding apparatus to primarily address concerns in terms of ergonomic problems such as carpel tunnel syndrome and the like, but it was found that in solving this problem it was also possible to increase capacity for stacked signatures within the same or a similar amount of floor space while operating at high speed and accepting signatures in a variety of different ways, e.g., by conventional human interface, log loading, and/or robot supply. Still additionally, such an apparatus was found to be capable of operation at high speed and to be capable of accommodating ink jet printing perpendicular to the backbone.

The present invention is thus directed to overcoming the foregoing problems and achieving the resulting objects as established by the development of the unique signature feeding apparatus described herein.

SUMMARY OF THE INVENTION

It is a principal object of the present invention to provide an improved apparatus for feeding signatures to a binding line. It is a further object of the present invention to provide a signature feeding apparatus which may be configured to feed signatures in either a shingled stream or one-at-a-time fashion wherein the apparatus accepts a high capacity of stacked signatures in a minimum amount of floor space and operates at high speed to increase productivity. It is an additional object of the present invention to provide a signature feeding apparatus sensitive to ergonomic problems.

Accordingly, the present invention is directed to an apparatus for feeding signatures to a binding line in such a manner as to achieve the foregoing objectives. The apparatus includes a pocket adjacent the binding line for receiving signatures to be delivered to the binding line. First and second means are provided for feeding signatures from a source to a signature transfer means extending to the pocket adjacent the binding line. The apparatus operates such that at least one of the feeding means receives signatures directly from the source. In a preferred embodiment, the first and second feeding means are adapted to feed signatures to the signature transfer means in a generally vertical stack.

Preferably, the signature transfer means has a signature receiving end positioned above the first and second feeding means and a signature transferring end positioned adjacent the pocket opposite the binding line. It is also within the present invention to provide means intermediate the feeding means and the pocket for printing on the signatures perpendicular to the backbones thereof. Additionally, the signature transfer means advantageously includes means for transferring signatures to the pocket in either a shingled stream or one-at-a-time fashion.

In a highly preferred embodiment, the apparatus is configured to include a pocket interface for delivering signatures to the pocket on the side of the pocket opposite the binding line. The signature transfer means then includes a signature receiving and separating end positioned above the generally vertical signature stack and, thus, above the first and second signature feeding means, and the signature transferring end of the signature transfer means is positioned adjacent the pocket interface. With this arrangement, at least one of the signature feeding means is preferably also generally vertically movable from a feeding position to a position for receiving signatures directly from the source.

More specifically, the one of the feeding means adapted to receive signatures directly from the source will advantageously comprise a lower feeding system while the other of the feeding means will comprise an upper feeding system. The lower feeding system will also comprise a portion of a signature receiving system adapted to control the absolute position of the lower feeding system when in the signature receiving position. The lower feeding system will further include a signature supporting plate which will advantageously be operatively associated with a drive system for vertically moving the plate. With this arrangement, the drive system is adapted to move the signature supporting plate from a vertical upper limit in the feeding position to a vertical lower limit in the signature receiving position.

Preferably, the signature receiving system includes sensing means operatively associated with the drive system for the signature supporting plate which is advantageously adjustably positioned at a preselected signature loading height that may be reset for each individual operator at any position intermediate the vertical upper limit and the vertical lower limit. The signature receiving system is such as to cause the drive system to initially position the signature supporting plate at the preselected signature loading height to assist a particular operator in placing signatures thereon when the signature supporting plate is in the signature receiving position. Still additionally, the sensing means is operable to cause the drive system to lower the signature supporting plate in such manner as to cause the top of the signatures placed thereon at any time by the operator to be maintained at the preselected signature loading height until such time as the signature supporting plate reaches the vertical lower limit.

As for the upper feeding system, it preferably includes signature supporting fingers operatively associated with a drive system for generally vertical movement thereof. More specifically, the drive system is adapted to move the signature supporting fingers from a vertical lower limit to a vertical upper limit, both in the feeding position.

In one embodiment, the signature receiving and separating end of the signature separation and transfer means includes shingling means adjacent the top of a generally vertical signature stack for forming signatures into a shingled stream for transfer to the pocket interface. Further, the signature separation and transfer means includes a shingled stream conveyor leading from the shingling means to the signature transferring end positioned adjacent the pocket interface for transferring signatures from the shingling means in the shingled stream.

In an alternative embodiment, the signature receiving and separating end of the signature separation and transfer means includes separating means adjacent the top of a generally vertical signature stack for forming signatures into a one-at-a-time stream for transfer to the pocket interface. Further, the signature separation and transfer means includes a conveyor leading from the separating means to the signature transferring end positioned adjacent the pocket interface for transferring signatures from the separating means in the one-at-a-time stream.

Preferably, in the alternative embodiment, means are provided along the conveyor for printing on the signatures perpendicular to the backbones thereof.

In the embodiment for transferring signatures in a shingled stream, the shingling means includes a central upwardly and outwardly inclined guide and a pair of signature edge supports laterally outward of the inclined guide for separating signatures into the shingled stream at the top of the generally vertical signature stack. The signature edge supports each have a ramp-like surface for the signatures and a pressurized air outlet in the ramp-like surface for assisting in separating the signatures into the shingled stream, and a central upwardly and outwardly inclined spring band is also provided in a position where it is spaced rearwardly of the inclined guide. Along with these details of the shingling means, a belt drive system is advantageously provided which includes a belt positioned between each of the signature edge supports and the inclined guide for moving signatures from the top of the generally vertical signature stack to a shingled stream conveyor.

Other features of the shingling means may advantageously include a jogger system associated with the signature receiving and separating end of the signature separation and transfer means for straightening signatures formed into the shingled stream. The shingled stream conveyor advantageously leads from the shingling means to the signature transferring end positioned adjacent the pocket interface for transferring signatures from the shingling means in the shingled stream.

When signatures are to be transferred in one-at-a-time fashion, the signature receiving and separating end of the signature separation and transfer means includes separating means adjacent the top of the generally vertical signature stack for forming signatures into a one-at-a-time stream for transfer to the pocket interface. The separating means preferably includes a linear gripper system in selective contact with the top of the generally vertical signature stack which comprises a vacuum signature pickup arm and roller means for moving signatures one at a time after gripping by the vacuum signature pickup arm. The separating means alternatively includes a vacuum belt system in contact with the top of the generally vertical signature stack which comprises a vacuum tube roller and a drive belt associated with the vacuum tube roller. With these features, the signature separation and transfer means may further include a conveyor leading from the separating means to the signature transferring end positioned adjacent the pocket interface for transferring signatures from the separating means in the one-at-a-time stream.

In operation of the upper and lower feeding systems, the lower feeding system feeds signatures until the signature supporting plate moves vertically above one sensor at which time the upper feeding system feeds signatures while the signature supporting plate moves to the signature receiving position to receive further signatures directly from the source. The upper feeding system then feeds signatures until the signature supporting fingers move vertically above another sensor at which time the lower feeding system moves to the feeding position so the signature supporting plate can take over feeding signatures from the signature supporting fingers of the upper feeding system.

Other objects, advantages and features of the present invention will become apparent from a consideration of the following specification taken in conjunction with the accompanying drawings.

BRIEF DESCRIPTION OF THE DRAWINGS

FIG. 9 is a further perspective view of the pocket interface for delivering signatures to a pocket;

FIG. 10 is a plan view of the signature supporting plate and the signature supporting fingers;

FIG. 15 is a perspective view of a signature supporting plate for the signature feeding apparatus;

FIG. 16 is a cross-sectional view of the signature feeding apparatus illustrated in FIG. 1; and FIG. 17 is a perspective view of a signature container for use with the signature feeding apparatus.

DETAILED DESCRIPTION OF THE PREFERRED EMBODIMENTS

Figure 1:
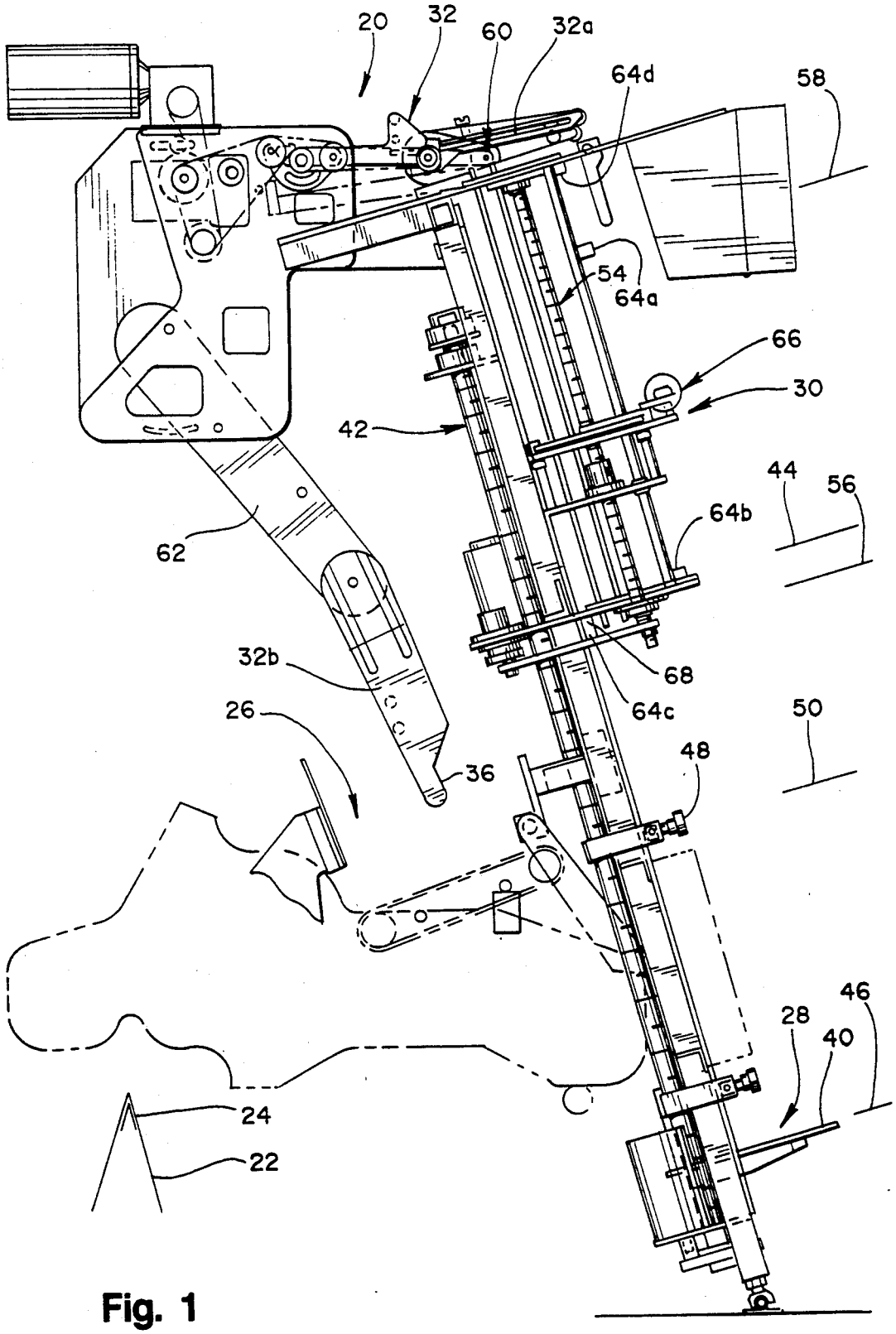
FIG. 1 is a side elevational view of a signature feeding apparatus in accordance with the present invention.

In the illustrations given, and with reference first to FIG. 1, the reference numeral 20 designates generally an apparatus for feeding signatures 22 to a binding line 24. The signature feeding apparatus 20 includes a pocket 26 adjacent the binding line 24 for receiving signatures 22 to be delivered to the binding line 24 (see, also, FIG. 8). It will also be appreciated by referring to FIG. 2 that the apparatus 20 includes first and second signature feeding means 28 and 30, respectively, for feeding signatures 22 from a source (not shown) to a signature transfer means 32 (see FIGS. 1 and 6). The signature feeding apparatus 20 further contemplates at least one of the feeding means 28 being adapted to receive signatures 22 directly from the source (see, also, FIG. 2). As will be appreciated from FIG. 1, the first and second feeding means 28 and 30 are adapted to feed signatures 22 to the signature transfer means 32 in a generally vertical but slightly inclined stack.

Figure 7:
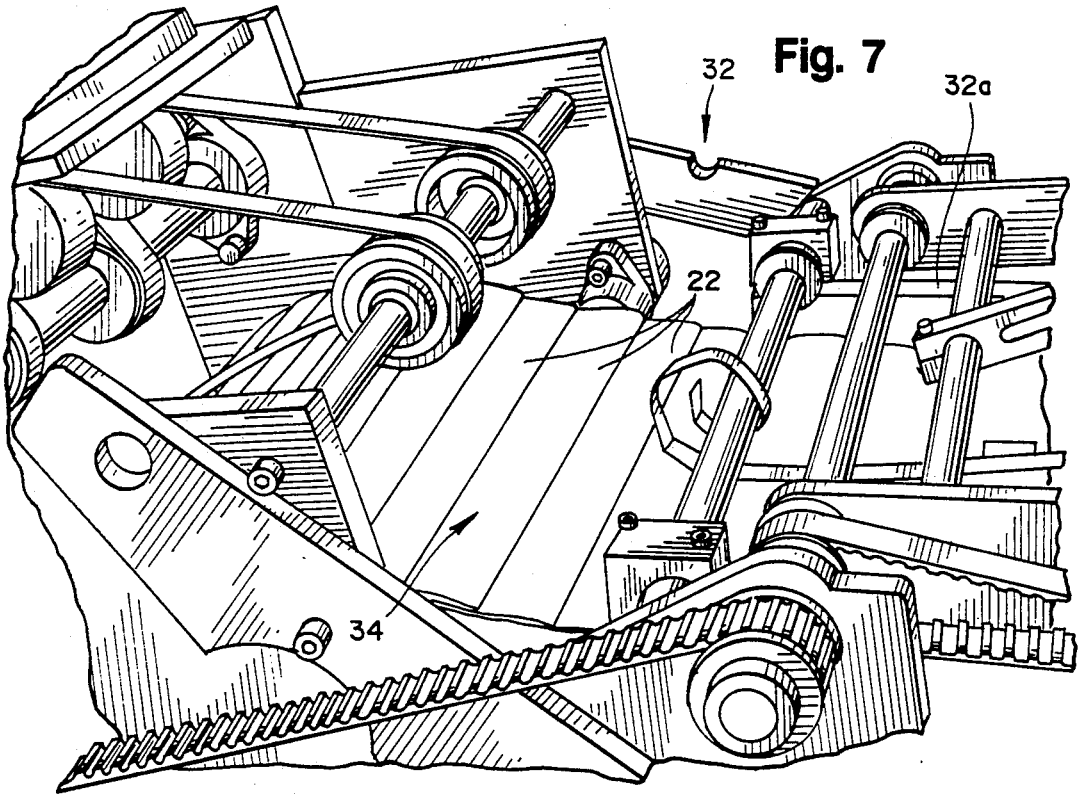
FIG. 7 is a still further detailed view of a signature separation and transfer means.

Referring to FIG. 1, the signature transfer means 32 has a signature receiving end 32*a* positioned above the first and second feeding means 28 and 30. It will also be seen that the signature transfer means 32 has a signature transferring end 32*b* positioned adjacent the pocket 26 opposite the binding line 24. As best shown in FIG. 7, the signature transfer means 32 includes means for transferring signatures 22 to the pocket 26 in shingled stream fashion as indicated at 34.

Figure 8:
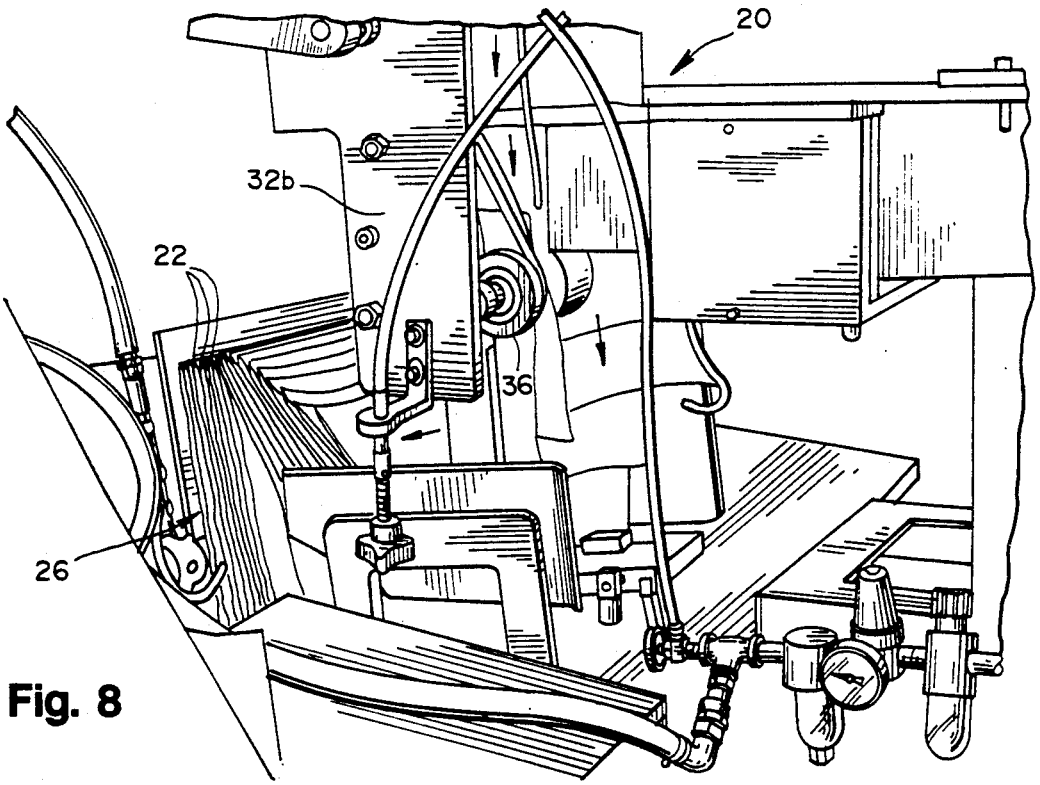
FIG. 8 is a perspective view of a pocket interface for delivering signatures to a pocket.

Referring to FIG. 8, the apparatus 20 includes a pocket interface 36 adjacent the binding line 24 for delivering signatures 22 to the pocket 26 for delivery to the binding line 24. It will also be appreciated from the foregoing discussion that the means for transferring signatures 22 to the pocket 26 in a shingled stream fashion as indicated at 34 (and as will be described in greater detail hereinafter) results in a certain separation of the signatures 22 whereby the signature transfer means 32 may be thought of as a signature separation and transfer means. As a result, the signature receiving end 32*a* actually comprises a signature receiving and separating end positioned above the generally vertical signature stack.

As will also be appreciated, the signature transferring end 32*b* of the signature separation and transfer means 32 is actually positioned adjacent the pocket interface 36 on the side of the pocket 26 opposite the binding line 24.

Figure 2:
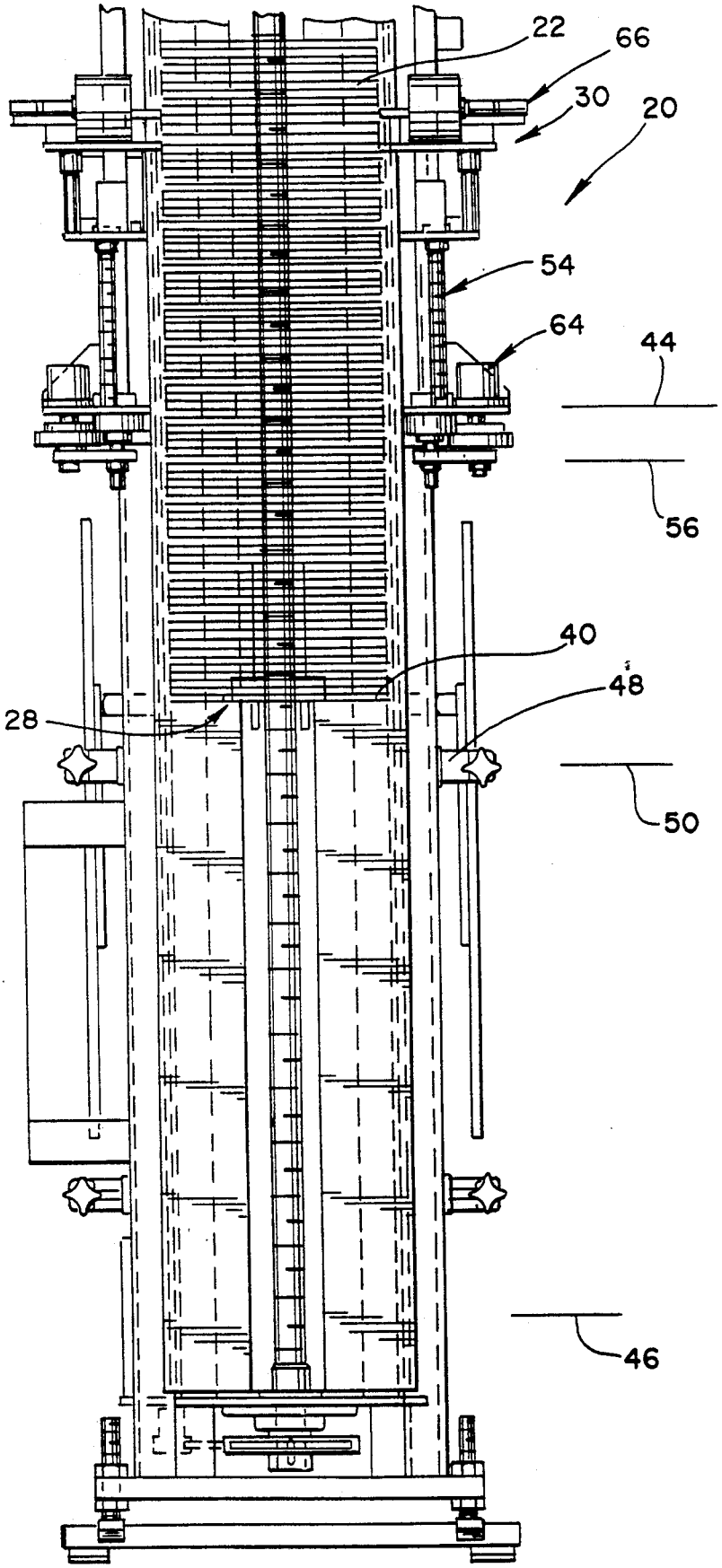
FIG. 2 is a rear elevational view of the signature feeding apparatus illustrated in FIG. 1.

As will be understood by comparing FIGS. 1 and 2, at least one of the feeding means 28 is generally vertically movable from a position for receiving signatures 22 directly from the source (see FIG. 1) to a feeding position (see FIG. 2). The feeding means 28 comprises a lower feeding system and the other of the feeding means 30 comprises an upper feeding system with the lower feeding system 28 including a signature supporting plate 40 (see FIG. 3). A drive system 42 is operatively associated with the signature supporting plate 40. The signature supporting plate 40 further comprises a portion of a signature receiving system 43 adapted to control the absolute position of the lower feeding system 28 when in the signature receiving position (see FIG. 1). In this connection, the drive system 42 is adapted to move the signature supporting plate 40 from a vertical upper limit 44 in the feeding position to a vertical lower limit 46 in the signature receiving position (see FIG. 2).

Figure 3:
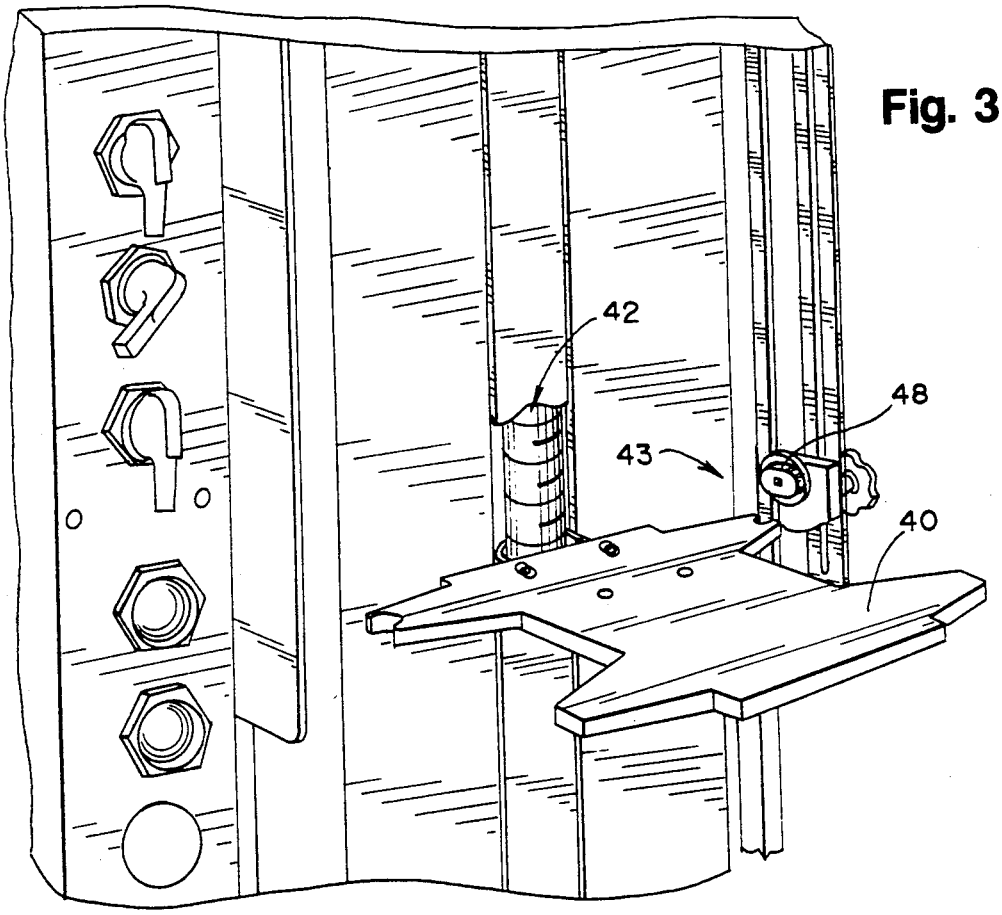
FIG. 3 is a detailed view of a portion of a lower feeding system including a signature supporting plate.

As shown in FIG. 3, the signature receiving system 43 includes sensing means 48 operatively associated with the drive system 42 for the signature supporting plate 40 which is adjustably positioned at a preselected signature loading height for an operator intermediate the vertical upper limit 44 and the vertical lower limit 46. The sensing means 48 causes the drive system 42 to initially position the signature supporting plate 40 at the preselected signature loading height 50 to assist the operator in placing signatures 22 thereon when the signature supporting plate 40 is in the signature receiving position for receiving signatures 22 from the source. The sensing means 48 causes the drive system 42 to lower the signature supporting plate 40 in such manner as to cause the top of the signatures 22 placed thereon at any time by the operator to be maintained at the preselected signature loading height 50 until the signature supporting plate 40 reaches the vertical lower limit 46, i.e., it bottoms out.

Figure 4:
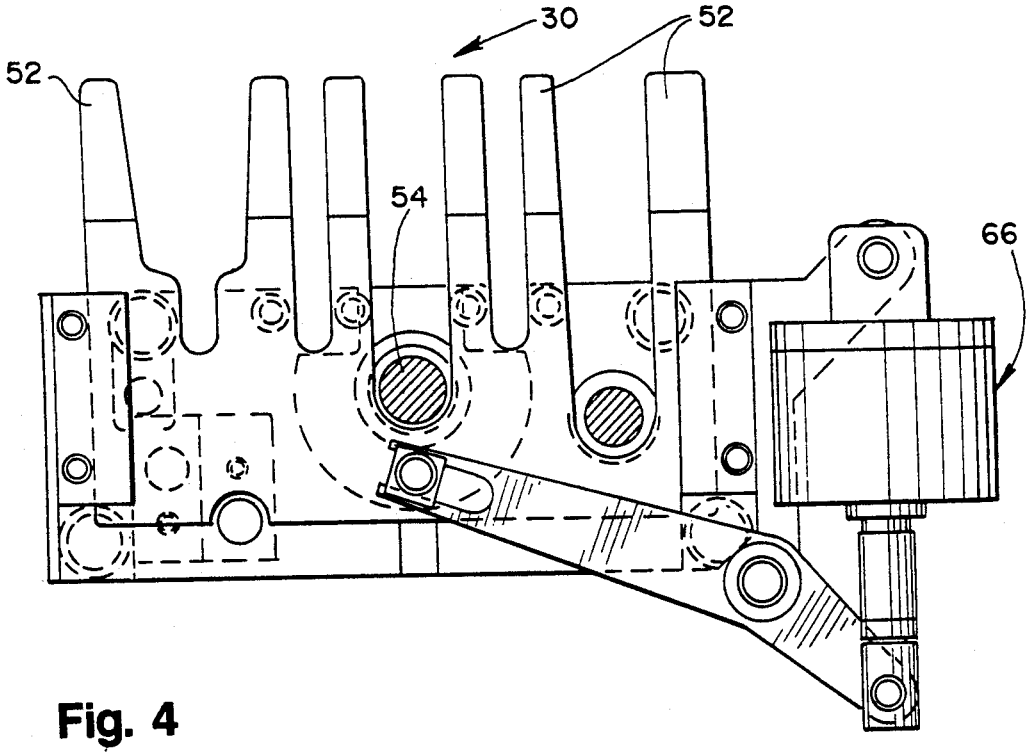
FIG. 4 is a detailed plan view of one side of an upper feeding system having signature supporting fingers.

Referring now to FIG. 4, the upper feeding system 30 includes signature supporting fingers 52 which are operatively associated with a drive system 54 for the fingers 52. As will be appreciated, the drive system 54 is adapted to move the signature supporting fingers 52 from a vertical lower limit 56 to a vertical upper limit 58 in the feeding position.

Figure 5:
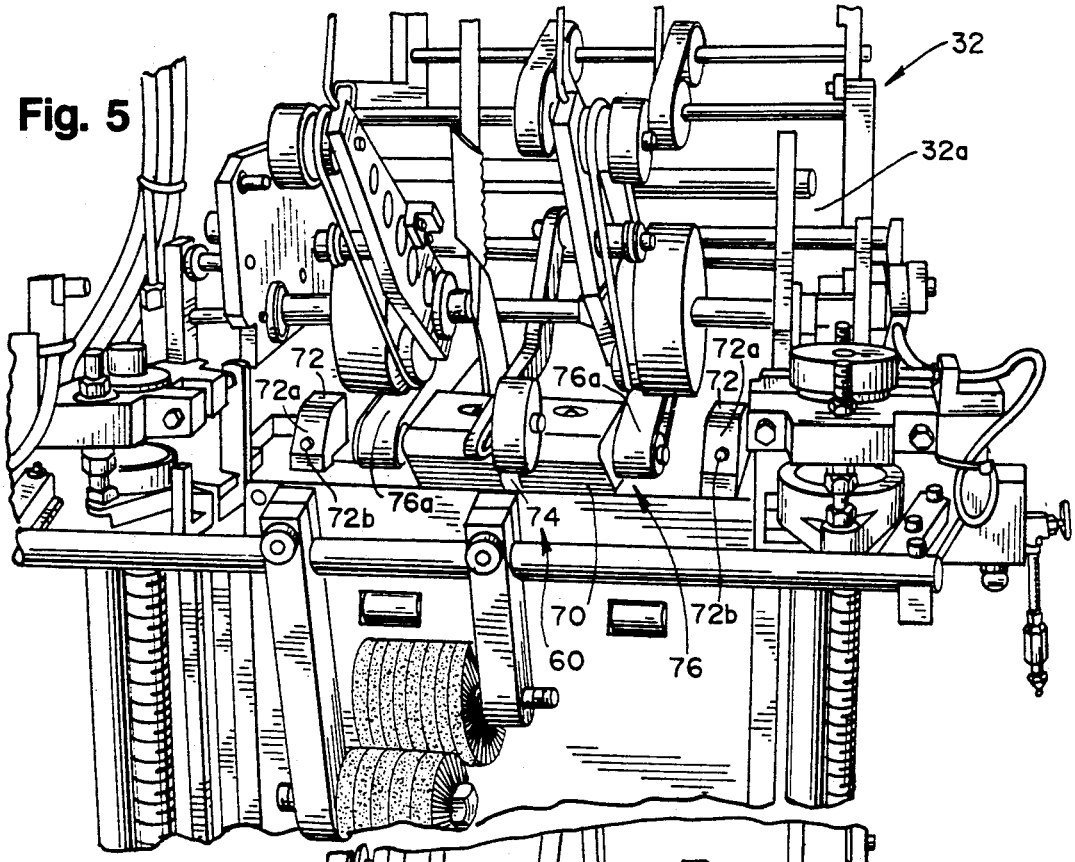
FIG. 5 is a detailed view of a portion of a signature separation and transfer means.
Figure 6:
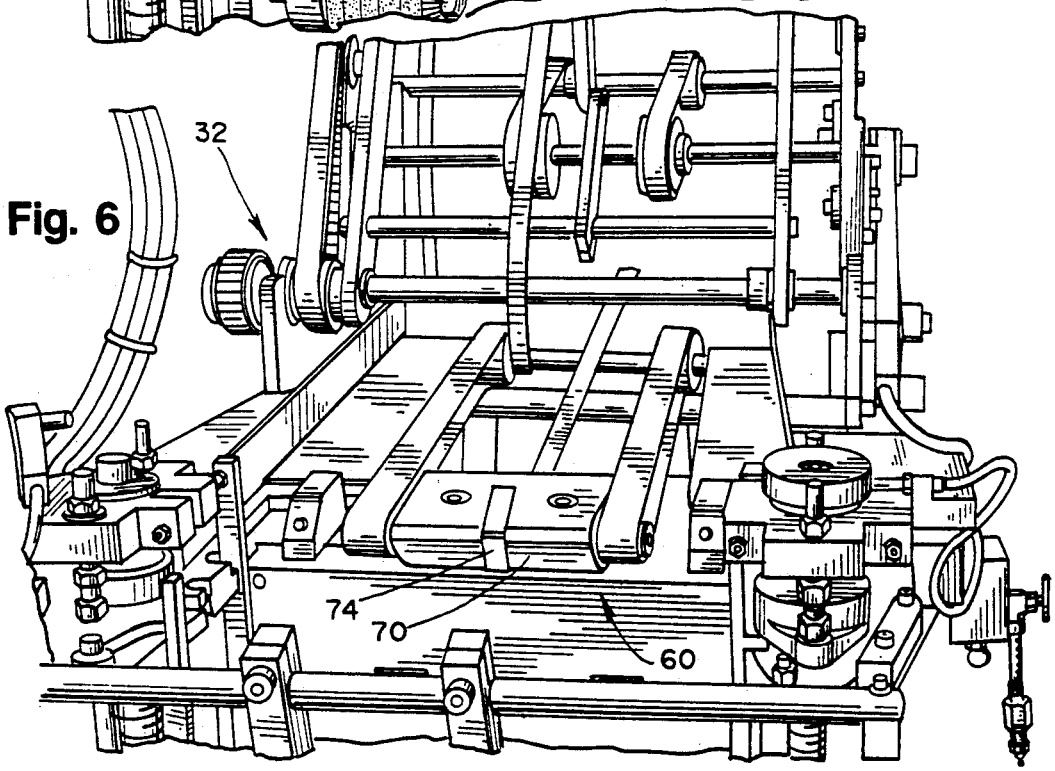
FIG. 6 is a further detailed view of a portion of a signature separation and transfer means.

Referring to FIGS. 5, 6 and 7, the signature receiving and separating end 32*a* of the signature separation and transfer means 32 includes shingling means 60 adjacent the top of the generally vertical signature stack for forming signatures 22 into a shingled stream for transfer to the pocket interface 36. The signature separation and transfer means 32 further includes a shingled stream conveyor 62 (see FIG. 1) which leads from the shingling means 60 to the signature transferring end 32*b* positioned adjacent the pocket interface 36 for transferring signatures 22 from the shingling means 60 in the shingled stream as at 34. Alternatively, and referring now to FIGS. 11 and 12, a signature receiving and separating end 132*a* of a signature separation and transfer means 132 may include separating means 160 adjacent the top of the generally vertical signature stack for forming signatures 22 into a one-at-a-time stream for transfer to the pocket interface 36. The signature separation and transfer means 132 may further include a conveyor 162 leading from the separating means 160 to the signature transferring end positioned adjacent the pocket interface 36 for transferring signatures 22 from the separating means 160 in a one-at-a-time stream as at 134.

Referring once again to FIG. 3, the signature receiving system 43 includes the receiving system sensing means 48 which is operatively associated with the drive system 42 for the signature supporting plate 40 in such manner as to be adjustably positioned at the preselected signature loading height 50 for an operator intermediate the vertical upper limit 44 and the vertical lower limit 46. As will be appreciated, the receiving system sensing means 48 causes the drive system 42 to initially position the signature supporting plate 40 at the preselected signature loading height 50 to assist the operator in placing signatures 22 thereon when the signature supporting plate 40 is in the signature receiving position for receiving signatures from the source.

Referring to FIG. 2, the signature feeding apparatus 20 also includes feeding system sensing means 64 operatively associated with the drive systems 42 and 54 of the lower and upper feeding systems 28 and 30, respectively. The feeding system sensing means 64 includes a first sensor 64*a* at the vertical upper limit 58 and a second sensor 64*b* at a position intermediate the vertical lower limit 56 and the vertical upper limit 58. The lower feeding system 28 feeds signatures 22 until the signature supporting plate 40 moves vertically above the second sensor 64*b*. The upper feeding system 30 then feeds signatures 22 while the signature supporting plate 40 moves to the signature receiving position 50 to receive further signatures 22 directly from the source. The upper feeding system 30 feeds signatures 22 until the signature supporting fingers 52 move vertically above the first sensor 64*a*. The lower feeding system 28 then moves to the feeding position so the signature supporting plate 40 can take over feeding signatures 22 from the signature supporting fingers 52 of the upper feeding system 30.

In addition, the feeding system sensing means 64 may include pressure sensitive means associated with the signature supporting fingers 52 which are carried by a retracting mechanism 66 responsive to a signal from the pressure sensitive sensing means. The feeding system sensing means 64 may alternatively include a third sensor 64*c* at the vertical lower limit 56 at a predetermined distance below the second sensor 64*b*. The third sensor 64*c* may then be operatively associated with the drive system 42 of the lower feeding system 28 as well as the signature supporting fingers 52 to accommodate transfer of the signature feeding function.

As for the drive systems 42 and 54, they are preferably of the screw drive type. The signature supporting fingers 52 are carried by the retracting mechanism 66 and the third sensor 64*c* is operatively associated with a counter 68 activated when the third sensor 64*c* senses signatures 22. With this arrangement, the counter 68 is operatively associated with the retracting mechanism 66.

More specifically, the counter 68 associates revolutions of the screw drive system 42 for the lower feeding system 28 with distance travelled. As a result, the counter 68 can activate the retracting mechanism 66 to retract the signature supporting fingers 52 when the lower feeding mechanism 28 has travelled a predetermined distance. Specifically, the predetermined distance will be that which is sufficient to position the top of the signatures 22 carried by the lower feeding system 28 adjacent the fingers 52.

In addition to the foregoing, the feeding system sensing means 64 may also include an automatic operation shut-off sensor 64*d* positioned above the first sensor 64*a* for terminating operation of the signature feeding apparatus 20 if the signature supporting fingers 52 should reach the automatic shut-off sensor 64*d*.

Referring to FIGS. 5, 6 and 7, the shingling means 60 includes a central upwardly and outwardly inclined guide 70 and a pair of signature edge supports 72 laterally outward of the inclined guide 70 for separating signatures into the shingled stream as at 34 at the top of the generally vertical signature stack. The signature edge supports 72 each have a ramp-like surface 72*a* for signatures 22 and a pressurized air outlet 72*b* in the ramp-like surface 72*a* for assisting in separating signatures 22 into the shingled stream as at 34, and the signature feeding apparatus 20 further includes a central upwardly and outwardly inclined spring band 74 (see FIG. 6) spaced outwardly of the inclined guide 70, and which can be seen by reason of the top guide portion of the signature separation and transfer means 32 being pivoted upwardly and away from its normal position during operation as illustrated in FIG. 1. In addition, the shingling means 60 includes a belt drive system 76 comprising a belt 76*a* positioned between each of the signature edge supports 72 and the inclined guide 70 for moving signatures 22 from the top of the generally vertical signature stack to the shingled stream conveyor 62.

Figure 6A:
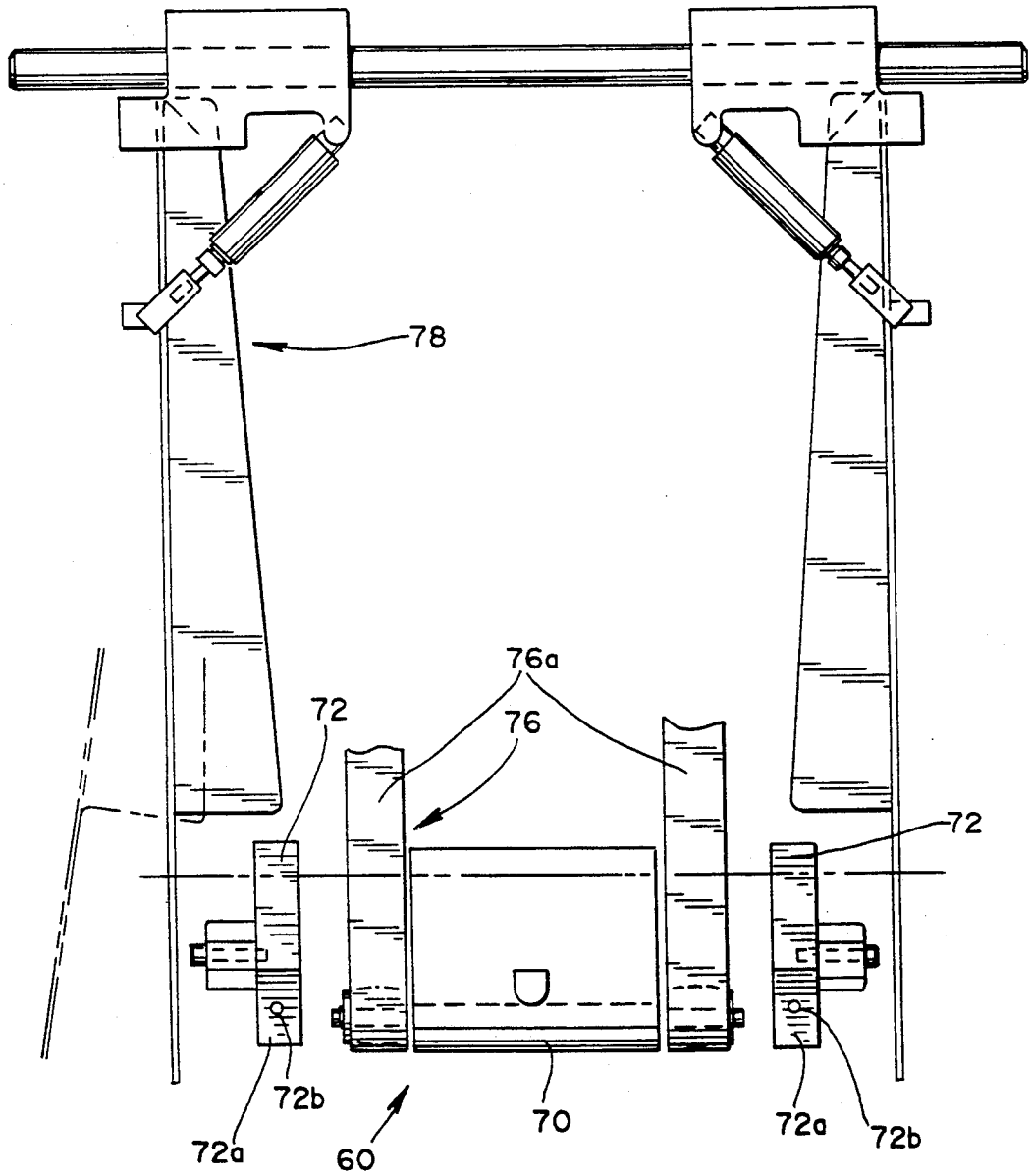
FIG. 6*a* is a plan view of a jogger system and the signature separation and transfer means.

As will be appreciated by specifically referring to FIGS. 6 and 6*a*, the shingling means 60 further includes a jogger system 78 associated with the signature receiving and separating end 32*a* of the signature separation and transfer means 32 for straightening signatures 22 formed into the shingled stream as at 34.

Figure 11:
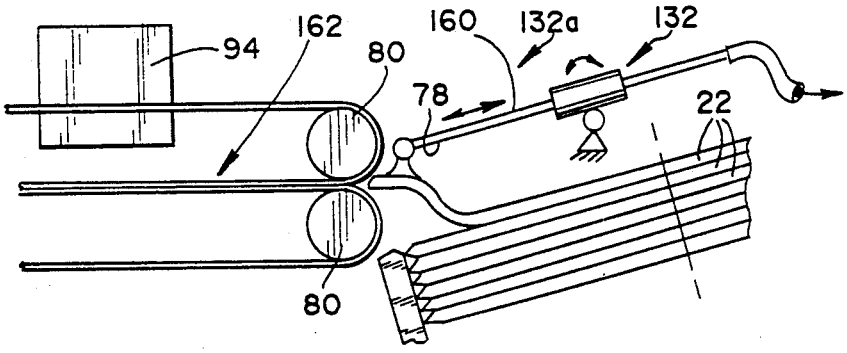
FIG. 11 is a schematic view of a linear gripper system for transferring signatures one at a time.
Figure 12:
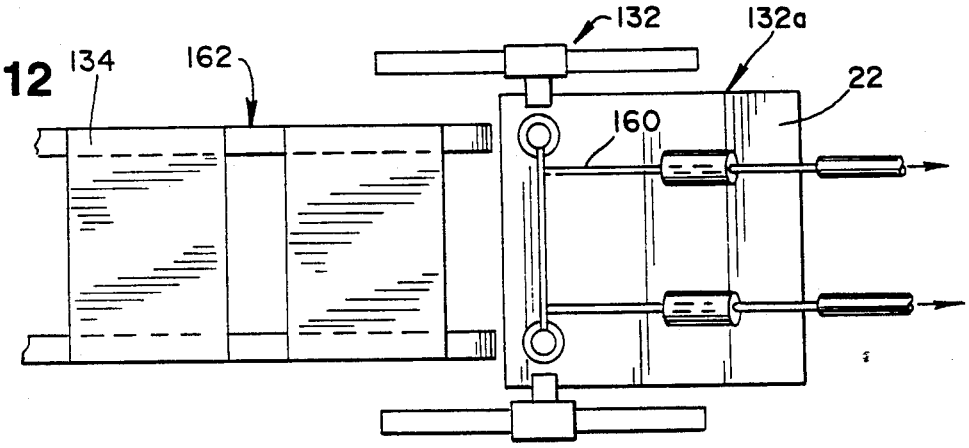
FIG. 12 is a plan view of a portion of the linear gripper system illustrated in FIG. 11.
Figure 13:
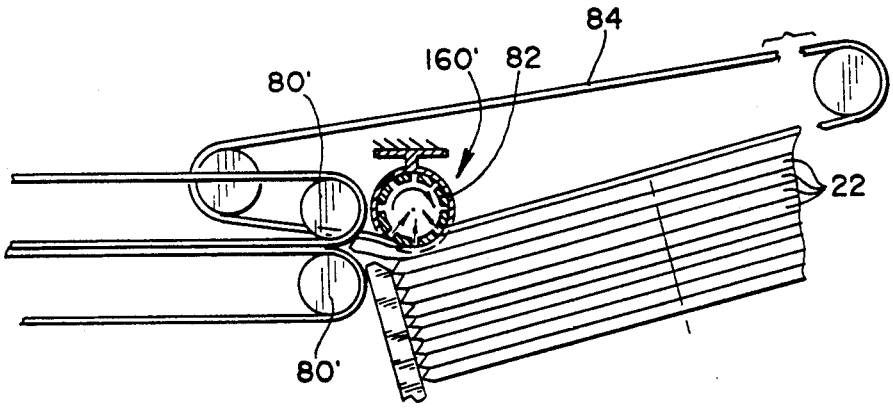
FIG. 13 is a schematic view illustrating a vacuum belt system for transferring signatures one at a time.

Referring to FIGS. 11 through 13, the separating means 160 may comprise a linear gripper system in selective contact with the top of the generally vertical signature stack (see FIG. 11). This has previously been mentioned hereinabove. In this embodiment, the linear gripper system 160 includes a vacuum signature pickup and delivery arm 78 and roller means 80 for moving signatures 22 one-at-a-time after gripping by the vacuum signature pickup and delivery arm 78.

In FIG. 13, the separating means 160′ includes a vacuum belt system in contact with the top of the generally vertical signature stack. With this arrangement, the vacuum belt system 160′ includes a vacuum tube roller 82 and a drive belt 84 associated with the vacuum tube roller 82. In this connection, roller means 80′ is provided for moving signatures one-at-a-time after gripping by the vacuum belt system 160′.

Figure 14:
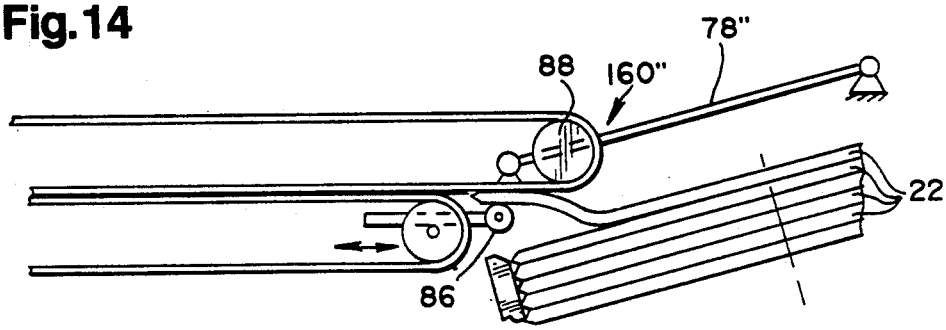
FIG. 14 is a schematic view illustrating a pinch roller system for transferring signatures one at a time.

In the embodiment illustrated in FIG. 14, the separating means 160″ includes a pinch roller system having a vacuum signature pickup arm 78″ in selective contact with the top of the generally vertical signature stack. With this arrangement, the pinch roller system 160″ operates by having the vacuum signature pickup arm 78″ lift a signature for gripping between a linearly reciprocating roller 86 and a vertically movable roller 88.

Referring now to FIGS. 15 through 17, the signature feeding means 28 may include means for receiving and feeding a log of signatures in a generally vertical stack. More specifically, the signature supporting plate 40 may have a signature band receiving recess 40*a* for removal of a band from the log and, as shown, the signature feeding apparatus 20 also has an inclined stack supporting surface 90 having a signature band receiving recess 90*a* for removal of a band from the log. In this manner, a log of signatures can be placed directly upon the signature supporting plate 40 following which the band and uppermost board may easily be removed.

If the signatures are placed upon the signature supporting plate 40 in log form, the lowermost board may be configured the same as the signature supporting plate. In this manner, the lowermost board may be retained on the signature supporting plate 40 while it is feeding signatures since it will not interfere with the operation of the apparatus, i.e., it will still be possible for the fingers 52 to move vertically past the supporting plate 40 and lowermost board without interference. By so configuring the lowermost of the boards, it is possible to load the logs of signatures onto the signature supporting plate in an automated fashion.

As shown in FIG. 17, the signature feeding apparatus 20 may be made capable of delivering a lift of signatures in a specially designed container 91. It will be seen that the container 91 has an open top 91*a*, an open front 91*b* so as to avoid interference between the portion of the signature supporting plate 40 which cooperates with the drive system 42, and an appropriately configured bottom portion 91*c* which allows the container 91 to be removed from the signature feeding apparatus 20 after a lift of signatures has been delivered to the signature supporting plate 40. In this manner, the signature feeding apparatus 20 is well suited for stocking with signatures by means of a robot (not shown).

As will be appreciated by referring to FIG. 10, the signature supporting plate 40 and the signature supporting fingers 52 are complementarily shaped. Thus, it is possible for them to move vertically past one another during the feeding and reloading operations that have been described hereinabove, as will also be the case when a log of signatures is delivered and the lowermost board is shaped identically with the signature supporting plate. In addition, FIG. 10 illustrates the retracting mechanism 66 as a piston driven eccentric arm-type of arrangement for reciprocating horizontal finger movement.

Referring to FIG. 9, still another aspect of the present invention has been illustrated. It will there be seen that the pocket interface 36 includes a pair of parallel vibrating bars 92 supporting signatures adjacent the pocket 26. Because of the vibrating bars 92, the signatures will be properly aligned as they enter the pocket 26.

Finally, and with reference to FIG. 11, the signature feeding apparatus 20 may include means intermediate the feeding means 28 and 30 and the pocket 26 for printing on the signatures 22 perpendicular to the backbones thereof. This may advantageously take the form of an ink jet printer 94 which, due to the one-at-a-time delivery fashion achieved with any of the embodiments illustrated in FIGS. 11 through 14, makes it possible to print in the desired perpendicular to the backbone fashion. As will be appreciated, one or more ink jet printers such as 94 may be located at any of a variety of convenient locations along the length of travel of the signatures 22 to the pocket 26.

With the signature feeding apparatus of the present invention, a highly effective top feed design has been provided. It is easily retrofitted to existing lines and has extremely low space requirements along with improved ergonomics that will cut carpel tunnel syndrome dramatically as well as provide major labor savings since an entire line can be fed with signatures by a single person or even in an automated fashion. In addition, the signature feeding apparatus admits of ink jet printing in the one-at-a-time delivery embodiment.

While in the foregoing there have been set forth preferred embodiments of the invention, it will be appreciated by those skilled in the art that the details herein given may be varied without departing from the true spirit and scope of the appended claims.

We claim:

1. An apparatus for feeding signatures to a binding line, comprising:

a pocket adjacent a binding line for receiving signatures to be delivered to said binding line;

first and second signature feeding means either one of which feeds signatures at any given time from a source to signature transfer means extending to said pocket adjacent said binding line; and at least one of said feeding means also receiving signatures directly from said source.

2. The signature feeding apparatus of claim 1 wherein said first and second feeding means are adapted to feed signatures to said signature transfer means in a generally vertical stack.

3. The signature feeding apparatus of claim 1 wherein said one of said feeding means includes means for receiving and feeding a log of signatures in a generally vertical stack.

4. The signature feeding apparatus of claim 1 wherein said signature transfer means has a signature receiving end positioned above said first and second feeding means.

5. The signature feeding apparatus of claim 1 wherein said signature transfer means has a signature transferring end positioned adjacent said pocket opposite said binding line.

6. The signature feeding apparatus of claim 1 wherein said signature transfer means includes means for transferring signatures to said pocket in a shingled stream fashion.

7. The signature feeding apparatus of claim 1 wherein said signature transfer means includes means for transferring signatures to said pocket in a one at a time fashion.

8. The signature feeding apparatus of claim 7 including means intermediate said feeding means and said pocket for printing on said signatures perpendicular to the backbones thereof.

9. An apparatus for feeding signatures to a pocket on a binding line, comprising:

a pocket interface adjacent a binding line for delivering signatures to said pocket for delivery to said binding line;

first and second signature feeding means either one of which feeds signatures at any given time from a source to signature separation and transfer means extending to said pocket interface;

said first and second feeding means being adapted to feed signatures to said signature separation and transfer means in a generally vertical stack, said signature separation and transfer means having a signature receiving and separating end positioned above said generally vertical signature stack and said first and second feeding means, said signature separation and transfer means also having a signature transferring end positioned adjacent said pocket interface on the side of said pocket opposite said binding line; and at least one of said feeding means also being generally vertically movable from a feeding position to a position for receiving signatures directly from said source.

10. The signature feeding apparatus of claim 9 wherein said one of said feeding means comprises a lower feeding system and the other of said feeding means comprises an upper feeding system, said lower feeding system also comprising a potion of a signature receiving system adapted to control the absolute position of said lower feeding system when in said signature receiving position.

11. The signature feeding apparatus of claim 10 wherein said lower feeding system includes a signature supporting plate operatively associated with a drive system for said plate, said drive system being adapted to move said signature supporting plate from a vertical upper limit in said feeding position to a vertical lower limit in said signature receiving position.

12. The signature feeding apparatus of claim 11 wherein said signature receiving system includes sensing means operatively associated with said drive system for said signature supporting plate, said sensing means being adjustably positioned at a preselected signature loading height for an operator intermediate said vertical upper limit and said vertical lower limit.

13. The signature feeding apparatus of claim 12 wherein said sensing means causes said drive system to initially position said signature supporting plate at said preselected signature loading height to assist said operator in placing signatures thereon when said signature supporting plate is in said signature receiving position for receiving signatures from said source.

14. The signature feeding apparatus of claim 13 wherein said sensing means causes said drive system to lower said signature supporting plate in such manner as to cause the top of said signatures placed thereon by said operator to be maintained at said preselected signature loading height until said signature supporting plate reaches said vertical lower limit.

15. The signature feeding apparatus of claim 10 wherein said upper feeding system includes signature supporting fingers operatively associated with a drive system for said fingers, said drive system being adapted to move said signature supporting fingers from a vertical lower limit in said feeding position to a vertical upper limit in said feeding position.

16. The signature feeding apparatus of claim 9 wherein said signature receiving and separating end of said signature separation and transfer means includes shingling means adjacent the top of said generally vertical signature stack for forming signatures into a shingled stream for transfer to said pocket interface.

17. The signature feeding apparatus of claim 16 wherein said signature separation and transfer means further includes a shingled stream conveyor leading from said shingling means to said signature transferring end positioned adjacent said pocket interface for transferring signatures from said shingling means in said shingled stream.

18. The signature feeding apparatus of claim 9 wherein said signature receiving and separating end of said signature separation and transfer means includes separating means adjacent the top of said generally vertical signature stack for forming signatures into a one at a time stream for transfer to said pocket interface.

19. The signature feeding apparatus of claim 18 wherein said signature separation and transfer means further includes a conveyor leading from said separating means to said signature transferring end positioned adjacent said pocket interface for transferring from said separating means in said one at a time stream.

20. The signature feeding apparatus of claim 19 including means along said conveyor for printing on said signatures perpendicular to the backbones thereof.

21. An apparatus for feeding signatures to a pocket on a binding line, comprising:

a pocket interface adjacent a binding line for delivering signatures to said pocket for delivery to said binding line;

first and second means for feeding signatures from a source to signature separation and transfer means extending to said pocket interface;

said first and second feeding means being adapted to feed signatures to said signature separation and transfer means in a vertically inclined stack, said signature separation and transfer means having a signature receiving and separating end positioned above said vertically inclined signature stack and said first and second feeding means, said signature separation and transfer means also having a signature transferring end positioned adjacent said pocket interface on the side of said pocket opposite said binding line; and at least one of said feeding means also being vertically movable from a feeding position to a position for receiving signatures directly from said source, said one of said feeding means comprising a lower feeding system and the other of said feeding means comprising an upper feeding system;

said lower feeding system comprising a portion of a signature receiving system adapted to control the absolute position of said lower feeding system when in said signature receiving position, said lower feeding system including a signature supporting plate operatively associated with a drive system for said plate, said drive system being adapted to move said signature supporting plate from a vertical upper limit in said feeding position to a vertical lower limit in said signature receiving position;

said upper feeding system including signature supporting fingers operatively associated with a separate drive system for said fingers, said drive system being adapted to move said signature supporting fingers from a vertical lower limit to a vertical upper limit in said feeding position.

22. The signature feeding apparatus of claim 21 wherein said signature receiving system includes receiving system sensing means operatively associated with said drive system for said signature supporting plate, said receiving system sensing means being adjustably positioned at a preselected signature loading height for an operator intermediate said vertical upper limit and said vertical lower limit.

23. The signature feeding apparatus of claim 22 wherein said receiving system sensing means causes said drive system to initially position said signature supporting plate at said preselected signature loading height to assist said operator in placing signatures thereon when said signature supporting plate is in said signature receiving position for receiving signatures from said source.

24. The signature feeding apparatus of claim 23 wherein said receiving system sensing means causes said drive system to lower said signature supporting plate in such manner as to cause the top of said signatures placed thereon by said operator to be maintained at said preselected signature loading height until said signature supporting plate reaches said vertical lower limit.

25. The signature feeding apparatus of claim 21 including feeding system sensing means operatively associated with said drive systems of said upper and lower feeding systems, said feeding system sensing means including a first sensor at said vertical upper limit and a second sensor at a position intermediate said vertical upper limit and said vertical lower limit.

26. The signature feeding apparatus of claim 25 wherein said lower feeding system feeds signatures until said signature supporting plate moves vertically above said second sensor, said upper feeding system then feeding signatures while said signature supporting plate moves to said signature receiving position to receive further signatures directly from said source.

27. The signature feeding apparatus of claim 26 wherein said upper feeding system feeds signatures until said signature supporting fingers move vertically above said first sensor, said lower feeding system then moving to said feeding position so said signature supporting plate can take over feeding signatures from said signature supporting fingers of said upper feeding system.

28. The signature feeding apparatus of claim 27 wherein said feeding system sensing means includes pressure sensitive sensing means associated with said signature supporting fingers, said signature supporting fingers being carried by a retracting mechanism responsive to a signal from said pressure sensitive sensing means.

29. The signature feeding apparatus of claim 27 wherein said feeding system sensing means includes a third sensor at said vertical lower limit at a predetermined distance below said second sensor, said third sensor being operatively associated with said drive system of said lower feeding system and said signature supporting fingers to accommodate transfer of signature feeding.

30. The signature feeding apparatus of claim 29 wherein said drive systems are of the screw drive type, said signature supporting fingers being carried by a retracting mechanism and said third sensor being operatively associated with a counter activated when said third sensor senses signatures, said counter being operatively associated with said retracting mechanism.

31. The signature feeding apparatus of claim 30 wherein said counter associates revolutions of said screw drive system for said lower feeding system with distance travelled, said counter activating said retracting mechanism to retract said signature supporting fingers when said lower feeding mechanism has travelled said predetermined distance.

32. The signature feeding apparatus of claim 27 wherein said feeding system sensing means includes an automatic operation shut-off sensor positioned above said first sensor for terminating operation when said signature supporting fingers reach said automatic shut-off sensor.

33. An apparatus for feeding signatures to a pocket on a binding line, comprising:

a pocket interface adjacent said binding line for delivering signatures to said pocket for delivery to said binding line;

first and second means for feeding signatures from a source to signature separation and transfer means extending to said pocket interface;

said first and second feeding means being adapted to feed signatures to said signature separation and transfer means in a generally vertical stack, said signature separation and transfer means having a signature receiving and separating end positioned above said generally vertical signature stack and said first and second feeding means, said signature separation and transfer means also having a signature transferring end positioned adjacent said pocket interface on the side of said pocket opposite said binding line;

at least one of said feeding means also being vertically movable from a feeding position to a position for receiving signatures directly from said source, said one of said feeding means comprising a lower feeding system and the other of said feeding means comprising an upper feeding system;

said lower feeding system including a signature supporting plate operatively associated with a drive system for said plate, said drive system being adapted to move said signature supporting plate from a vertical upper limit in said feeding position to a vertical lower limit in said signature receiving position, said lower feeding system also comprising a portion of a signature receiving system adapted to control the absolute position of said lower feeding system when in said signature receiving position;

said signature receiving system including receiving system sensing means operatively associated with said drive system for said signature supporting plate and adjustably positioned at a preselected signature loading height for an operator intermediate said vertical upper limit and said vertical lower limit, said receiving system sensing means causing said drive system to initially position said signature supporting plate at said preselected signature loading height to assist said operator in placing signatures thereon when said signature supporting plate is in said signature receiving position for receiving signatures from said source, said receiving system sensing means causing said drive system to lower said signature supporting plate in such manner as to cause the top of said signatures placed thereon by said operator to be maintained at said preselected signature loading height until said signature supporting plate reaches said vertical lower limit;

said upper feeding system including signature supporting fingers operatively associated with a separate drive system for said fingers, said drive system being adapted to move said signature supporting fingers from a vertical lower limit to a vertical upper limit in said feeding position; and feeding system sensing means operatively associated with said separate drive systems of each of said upper and lower feeding systems, said feeding system sensing means including a first sensor at said vertical upper limit, said feeding system sensing means also including a second sensor at a position intermediate said vertical upper limit and said vertical lower limit.

34. The signature feeding apparatus of claim 33 wherein said signature receiving and separating end of said signature separation and transfer means includes shingling means adjacent the top of said generally vertical signature stack for forming signatures into a shingled stream for transfer to said pocket interface.

35. The signature feeding apparatus of claim 34 wherein said shingling means includes a central upward and rearward inclined guide and a pair of signature edge supports laterally outward of said inclined guide for separating signatures into said shingled stream at the top of said generally vertical signature stack.

36. The signature feeding apparatus of claim 35 wherein said signatures edge supports each have a ramp-like surface for signatures and a pressurized air outlet in said ramp-like surface for assisting in separating signatures into said shingled stream and including a central upward and rearward inclined spring band spaced rearwardly of said inclined guide.

37. The signature feeding apparatus of claim 36 wherein said shingling means further includes a belt drive system including a belt positioned between each of said signature edge supports and said inclined guide for moving signatures from the top of said generally vertical signature stack to a shingled stream conveyor.

38. The signature feeding apparatus of claim 34 wherein said shingling means further includes a jogger system associated with said signature receiving and separating end of said signature separation and transfer means for straightening signatures formed into said shingled stream.

39. The signature feeding apparatus of claim 34 wherein said signature separation and transfer means further includes a shingled stream conveyor leading from said shingling means to said signature transferring end positioned adjacent said pocket interface for transferring signatures from said shingling means in said shingled stream.

40. The signature feeding apparatus of claim 33 wherein said signature receiving and separating end of said signature separation and transfer means includes separating means adjacent the top of said generally vertical signature stack for forming signatures into a one at a time stream for transfer to said pocket interface.

41. The signature feeding apparatus of claim 40 wherein said separating means includes a linear gripper system in selective contact with the top of said generally vertical signature stack, said linear gripper system including a vacuum signature pick-up arm and roller means for moving signatures one at a time after gripping by said vacuum signature pick-up arm.

42. The signature feeding apparatus of claim 40 wherein said separating means includes a vacuum belt system in contact with the top of said generally vertical signature stack, said vacuum belt system including a vacuum tube roller and a drive belt associated with said vacuum tube roller.

43. The signature feeding apparatus of claim 40 wherein said signature separation and transfer means further includes a conveyor leading from said separating means to said signature transferring end positioned adjacent said pocket interface for transferring from said separating means in said one at a time stream.

44. The signature feeding apparatus of claim 41 including means along said conveyor for printing on said signatures perpendicular to the backbones thereof.

45. The signature feeding apparatus of claim 33 wherein said lower feeding system feeds signatures until said signature supporting plate moves vertically above said second sensor, said upper feeding system then feeding signatures while said signature supporting plate moves to said signature receiving position to receive further signatures directly from said source.

46. The signature feeding apparatus of claim 45 wherein said upper feeding system feeds signatures until said signature supporting fingers move vertically above said first sensor, said lower feeding system then moving to said feeding position so said signature supporting plate can take over feeding signatures from said signature supporting fingers of said upper feeding system.

47. The signature feeding apparatus of claim 46 wherein said feeding system sensing means includes pressure sensitive sensing means associated with said signature supporting fingers, said signature supporting fingers being carried by a retracting mechanism responsive to a signal from said pressure sensitive sensing means.

48. The signature feeding apparatus of claim 46 wherein said feeding system sensing means includes a third sensor at said vertical lower limit at a predetermined distance below said second sensor, said third sensor being operatively associated with said drive system of said lower feeding system and said signature supporting fingers to accommodate transfer of signature feeding.

49. The signature feeding apparatus of claim 48 wherein said drive systems are of the screw drive type, said signature supporting fingers being carried by a retracting mechanism and said third sensor being operatively associated with a counter activated when said third sensor senses signatures, said counter being operatively associated with said retracting mechanism.

50. The signature feeding apparatus of claim 49 wherein said counter associates revolutions of said screw drive system for said lower feeding system with distance travelled, said counter activating said retracting mechanism to retract said signature supporting fingers when said lower feeding mechanism has travelled said predetermined distance.

51. The signature feeding apparatus of claim 46 wherein said feeding system sensing means includes an automatic operation shut-off sensor positioned above said first sensor for terminating operation when said signature supporting fingers reach said automatic shut-off sensor.

52. The signature feeding apparatus of claim 33 wherein said one of said feeding means includes means for receiving and feeding a log of signatures in a generally vertical stack.

53. The signature feeding apparatus of claim 52 wherein said signature supporting plate has a signature band receiving recess for removal of a band from said log.

54. The signature feeding apparatus of claim 52 including an inclined stack supporting surface having a signature band receiving recess for removal of a band from said log.

55. The signature feeding apparatus of claim 33 wherein said signature supporting plate and said signature supporting fingers are complementarily shaped.

56. The signature feeding apparatus of claim 33 wherein said pocket interface includes a pair of parallel vibrating bars supporting signatures adjacent said pocket

* * * * *